US006406120B2

(12) United States Patent
Pauschinger

(10) Patent No.: US 6,406,120 B2
(45) Date of Patent: Jun. 18, 2002

(54) POSTAGE METER MACHINE WITH PROTECTED PRINT HEAD

(75) Inventor: Dieter Pauschinger, Berlin (DE)

(73) Assignee: Francotyp-Postalia AG & Co., Birkenwerder (DE)

( * ) Notice: Subject to any disclaimer, the term of this patent is extended or adjusted under 35 U.S.C. 154(b) by 0 days.

(21) Appl. No.: 09/801,544

(22) Filed: Mar. 7, 2001

(30) Foreign Application Priority Data

Mar. 8, 2000 (DE) ..... 100 11 192

(51) Int. Cl.[7] ..... B41J 2/175; G07B 17/04

(52) U.S. Cl. ..... 347/19; 347/87; 400/175; 705/60; 705/408

(58) Field of Search ..... 347/2, 5, 7, 14, 347/19, 86, 87; 400/175; 705/60, 408

(56) References Cited

U.S. PATENT DOCUMENTS

| | | | | |
|---|---|---|---|---|
| 4,813,912 A | * | 3/1989 | Chickneas et al. | 705/60 |
| 4,872,027 A | | 10/1989 | Buskirk et al. | 347/19 |
| 5,831,649 A | * | 11/1998 | Watrobski et al. | 347/19 |
| 5,956,051 A | * | 9/1999 | Davies et al. | 347/2 |
| 6,212,505 B1 | * | 4/2001 | Herbert | 705/408 |

FOREIGN PATENT DOCUMENTS

| | | |
|---|---|---|
| EP | 0 522 809 | 7/1992 |
| EP | 0 775 984 | 5/1997 |
| EP | 0 875 861 | 11/1998 |
| EP | 0 875 862 | 11/1998 |
| EP | 0 875 865 | 11/1998 |
| EP | 0 927 972 | 7/1999 |
| FR | 2 774 494 | 8/1999 |

* cited by examiner

*Primary Examiner*—John Barlow
*Assistant Examiner*—Blaise Mouttet
(74) *Attorney, Agent, or Firm*—Schiff Hardin & Waite

(57) ABSTRACT

In a postage meter machine that has a printing unit with a replaceable print head, a print head for such a postage meter machine and a method for the authentication of such a print head, a number of manipulation possibilities are precluded, such as refilling an authorized print head, unauthorized ink usage of a printhead and using an authorized print head in a conventional printer without paying fees for franking. For this purpose a security code is generated by an encryption algorithm from a first identification code attached to the print head and from a second identification code stored in a memory unit allocated to the print head, and is compared to a security code that is likewise stored in the memory unit when the print head is manufactured.

13 Claims, 3 Drawing Sheets

POSTAGE METER MACHINE WITH PROTECTED PRINT HEAD

BACKGROUND OF THE INVENTION

1. Field of the Invention

The present invention is directed to a postage meter machine for franking postal matter according to the preamble as well as to a print head for such a postage mater machine as well as to a method for authentication of such a print head.

2. Description of the Prior Art

A postage meter machine having a replaceable print head is disclosed by European Application 0 875 862. The print head therein has a memory element in which an identification code of the print head is stored. The postage meter machine can read this identification code with a reader and check whether the print head is authorized for that postage meter machine.

Print heads for postage meter machines are usually fashioned as disposable print heads and have an ink reservoir, drive electronics and ink nozzles from which the ink is applied onto the letter. For minimizing possibilities of manipulation, such print heads must satisfy a number of postal authority requirements. Thus, an unauthorized print head should be prevented from being used and an authorized print head should be prevented from being used with unauthorized ink. It is particularly important to prevent a customer filling the customer's print head with unauthorized ink and to prevent a professional recycler from collecting unauthorized print heads and fills these with unauthorized ink and distributing them. Moreover, measures against misuse referred to as a "replay attack," wherein frankings are copied with a number of postage meter machines, and against the employment of postally approved print heads in normal printers, should be provided.

It has developed that critical weak points of known postage meter machines are that the print head does not "know" its own ink filling level, and that the filling level cannot be interrogated from the outside with suitable electronics. Refilling of such a print head with unauthorized ink therefore is easy to perform. However, even if the print head were to know its filling level, this could still be manipulated as described above. Moreover, it is often not possible to distinguish an authorized print head from an unauthorized print head in an electronic way. A further disadvantage of the postage meter machine disclosed by European Application 0 875 862 is that the postage meter machine must know the identification code stored in the memory unit of the print head, or must know which identification codes enable an authorization. Moreover, no measures against refilling and other possibilities for misuse are provided in this postage meter machine.

SUMMARY OF THE INVENTION

An object of the present is to provide measures in a postage meter machine or in a print head for a postage meter machine in order to prevent the above-described abuses. It is further an object to provide for the authentication of a print head.

The above object is achieved in accordance with the principles of the present invention in a postage meter machine, as well as in a print head for a postage meter machine, as well as in a method for authentication of a print head, wherein a security code is generated using an encryption algorithm from a first identification code that is attached to the print head and from a second identification code that is stored in a memory unit allocated to the print head. This generated security code, upon insertion of the print head in the postage meter machine, is compared to a security code that was also stored in the memory unit when the print head was manufactured. If the generated security code and the stored security code do not match, usage of the print head is not enabled.

According to the invention, the postage meter machine need not know what identification codes allow an authorization of the print head; rather, the postage meter machine itself generates a security code with a general encryption algorithm, which is compared to a security code stored on the memory unit. For generating the security code, the postage meter machine reads out a first identification code applied to the print head and a second identification code stored in the memory unit of the print head. These identification codes are subjected to the encryption algorithm, which can be a standard algorithm (for example, a DES=data encryption standard), which then generates the security code with a key code. This generated security code is then compared to a security code that is likewise stored in the memory unit of the print head, and, given agreement, the print head is authorized and the printer unit is enabled.

For example, the manufacturer of the print head or of the postage meter machine has generated the security code stored in the memory unit of the print head with the same encryption algorithm and the same key code and stored it in the memory unit. Differing from known postage meter machines, the inventive postage meter machine need not "know" what code allows an authentication of the print head; rather, the security code is generated from data that are read from the print head and the memory unit and compared to a security code stored in the memory unit. Since two identification codes are required for generating the security code, and since these are accommodated at separate locations, namely at the print head and in the memory unit, it is also not possible to employ the memory unit for a different print head.

Further mechanical measures for preventing manipulations can be provided to prevent the print head from being employed in conventional printers in order to generate frankings without paying for them.

The memory unit can be permanently attached to the print head or can also input installed in the postage meter machine separate from the print head. However, a memory unit is always allocated to only one print head.

The memory unit can be a chip card. This simultaneously acts as a mechanical impediment to employing the print head in conventional printers.

In a preferred embodiment that the security code is generated before the first use, for example upon manufacture of the print head, and is stored in the memory unit, and the key code is a code allocated to the manufacturer of the print head and/or of the postage meter machine. It is thus necessary that both the manufacturer of the print head and the manufacturer of the postage meter machine employ the same encryption algorithm and the same key code, so that the same security code can be generated. Insofar as the key code is kept secret, a generally known and accessible encryption algorithm can be employed for this purpose. Alternatively, the key code can be specific for the manufacturers of postage meter machines as well as for the manufacturer of the print heads.

In a further embodiment for the selection of the identification code an arbitrary number is attached to the print head as a first identification code and a serial number is stored in the memory as a second identification code. The selection of the serial number and the selection of the arbitrary number are preferably left to the manufacturer of the print head. An arbitrary number, for example an 8 bit number, and a serial number are thus generated, the security code being subsequently generated from these and being ultimately stored in the memory unit together with the serial number. The number, the serial number and the security code thus belong together and can only effect an authentication of a print head together.

In a further embodiment a connection unit is attached to the print head for connecting the print head to a print control unit, which is a part of the printer unit of the postage meter machine. The connection unit connects contacts of the print control unit to contacts of the print head, these connections being permutated according to a permutation code. The print control unit operates the print head according to the permutation of the contacts. The connection unit, which connects contacts of the print control unit to contacts of the print head, thereby exhibits a permutation of the connections that must be taken into consideration in the transmission of the print signal by the print control unit. This means that the contacts are transposed according to a permutation code stored on the memory unit. This is intended to prevent non-authorized print heads from being inserted and frankings from being generated therewith. Since each of the print heads exhibits an individual permutation, misuse referred to as replay attacks is thereby also prevented, i.e. meaningful frankings can only be generated with this print head proceeding from a single postage meter machine.

The permutation code can be attached to the print head, and can serve as the aforementioned first identification code. A serial number can be stored in the memory unit to serve as the aforementioned second identification code.

In a further embodiment, the print head's consumption of ink is measured and stored. When the ink has been completely used, a corresponding identifier is stored on the memory unit, which prevents further printing with this print head even when ink is refilled into the print head. For example, the security code stored on the memory unit can be deleted or modified in this case, this necessarily preventing further use of the print head. The storing of the current ink usage and the "used up" identifier can also ensue in the postage meter machine.

DESCRIPTION OF THE PREFERRED EMBODIMENTS

Figure 1:
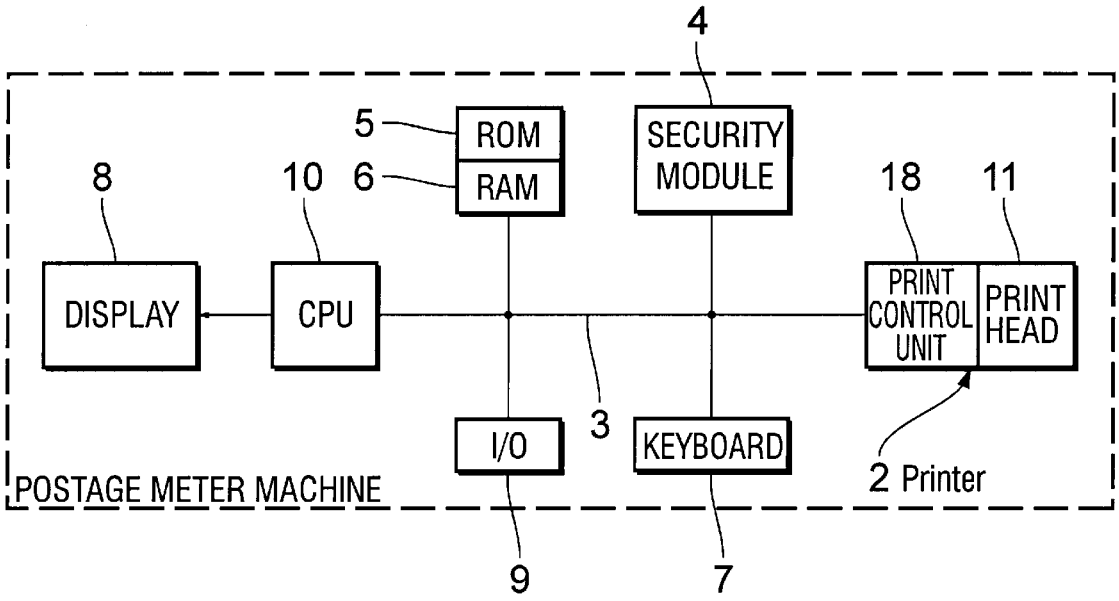
FIG. 1 is a block circuit diagram of an inventive postage meter machine.

FIG. 1 shows a block circuit diagram of an inventive postage meter machine 1 with its basic electrical function units. A central computer unit 10 controls the printing of the print image with a printer 2. The printer 2 includes a print head 11 and a print control unit 18. The computer unit 10 is connected to the security module 4 and to the printer 2 (i.e., the print control unit 18 thereof) via a control bus 3 that contains address, data and control lines. Further, the computer unit 10 is connected via the control bus 3 to a non-volatile memory 5 and to a main memory 6 wherein a central control program and templates (formats) for compiling the print image are stored. A user can operate the postage meter machine and, for example, prescribe the print image via a keyboard 7 connected to the control bus 3. The executive sequences in the postage meter machine 1 are displayed on a display 8. Drive elements and sensors, which are not shown, monitor various status conditions of the postage meter machine 1. An input/output (I/O) unit 9 is connected to the computer unit 10 via the bus 3. Moreover, a transport system (not shown) for transporting the postal matter is connected to the postage meter machine 1.

Figure 2A:
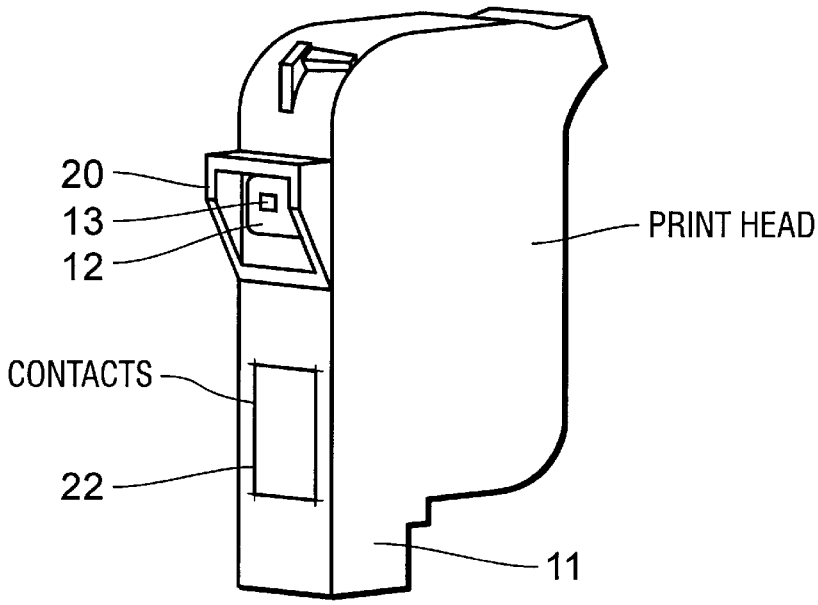
FIG. 2A is a perspective view of an inventive print head.

An inventive print head 11 for the printer 2 is shown in FIG. 2. This is fashioned as a disposable print head and operates according to the ink jet method. As a memory unit, a chip card 12 with a memory chip 13 located thereon is attached thereto. The chip card 12 is thereby mechanically attached such that the print head 11 cannot be employed in traditional ink jet printers. Instead of the chip card 12, only the memory chip 13 can be attached to the print head 11, by means of contacts at its surface. The chip card 12 (or the memory chip 13) if used by itself has contacts (not shown) for reading out the contents of the memory chip 13. Moreover, the print head is provided with a projection 20 which mechanically prevents the print head 11 from being inserted into a conventional printer. In practice, the print head 11 can be integrated into the lower end of a commercially available disposable ink cartridge. The print head 11 has contacts 22 connected to an integrated read only memory of the print head 11. Commercial print heads are available, such as from HP, having such an integrated ROM for storing the serial number, for example. Further details of the inventive fashioning of the print head 11 are explained on the basis of FIGS. 3 and 4.

Figure 3:
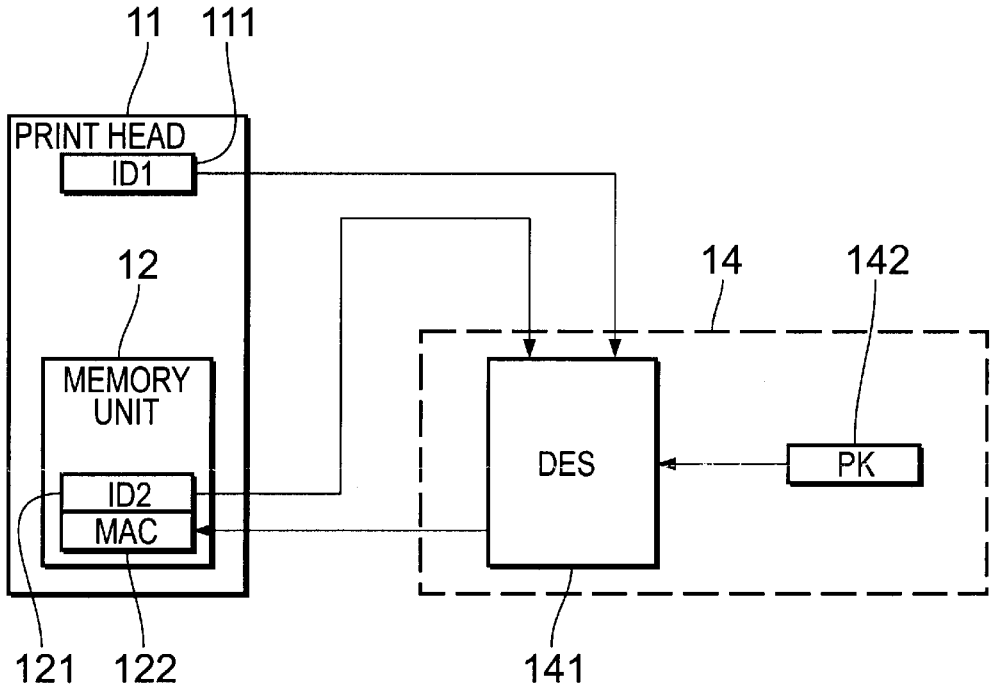
FIG. 3 is a block circuit diagram for explaining the structure of the inventive print head.

FIG. 3 shows the method steps that ensue when constructing a print head in accordance with the invention. First, a first identification code ID1 (for example, an 8 bit number) is attached to the print head itself in step 111, such as by storage in the aforementioned integrated ROM. A second identification code ID2 (for example, a unique serial number) is stored (or will be stored) in a memory location 121 of the memory device (chip card) 12. Together with the first identification code ID1, the second identification code ID2 is conducted to an encryption unit 141 in a computer unit 14 of the print head manufacturer. A security code MAC (message authentication code) is generated therefrom in the encryption unit 141 and, with a key code PK entered at the input unit 142, the security code MAC is stored in the memory cell 122 of the memory unit 12.

Figure 2B:
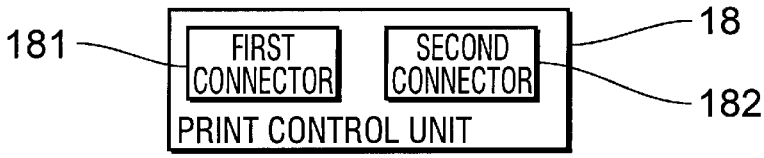
FIG. 2B is a schematic illustration of a print control unit for use with the print head of FIG. 2A.
Figure 4:
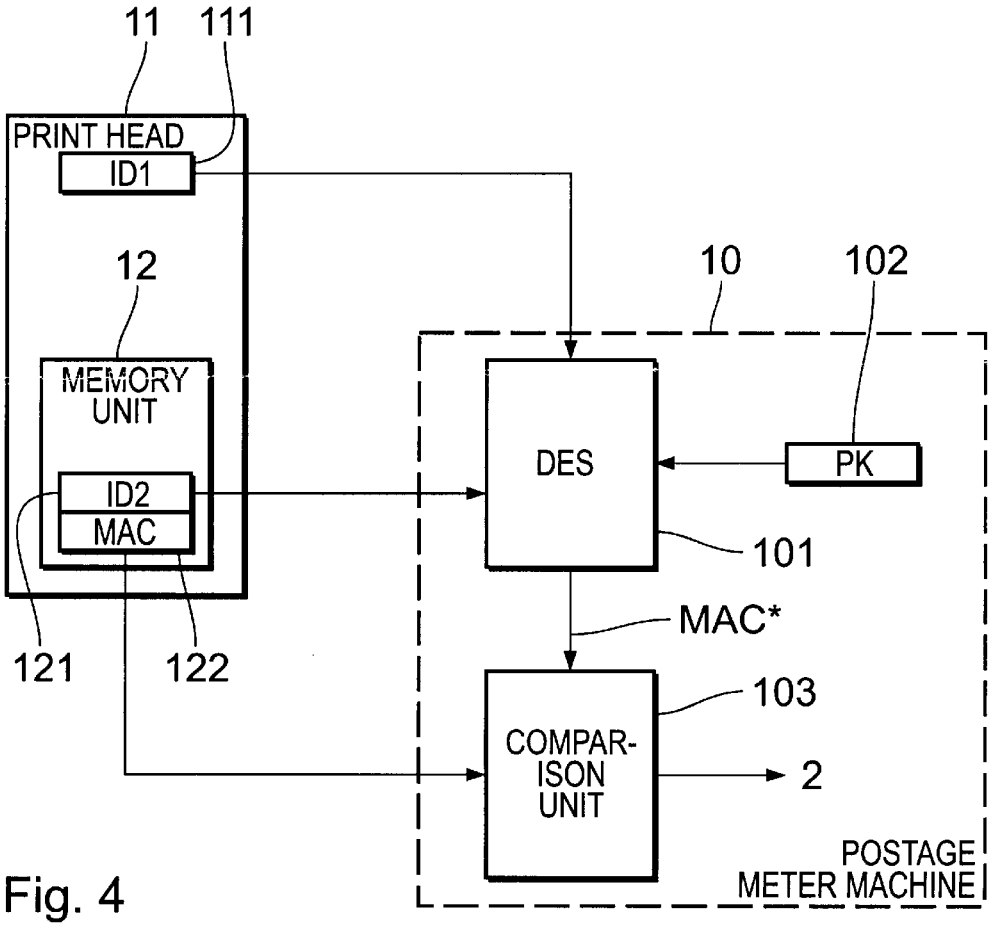
FIG. 4 is a block circuit diagram for explaining the authentication procedure of an inventive print head.

In order to now verify whether a print head 11 is also authorized for printing frankings and as shown in FIG. 4, upon insertion of the print head 11 in the printer 2, the first identification code ID1 is read from the print head 11, and the second identification code ID2 and the security code MAC are read out from the memory unit (chip card 12). This is accomplished by a connector 181 at the print control unit 18 for reading the contents of the memory 13, and a connector 182 for the contacts 22 to allow read out of the integrated ROM in the print head 11, as schematically shown in FIG. 2B. A decryption unit 101 in the computer unit 10 of the postage meter machine is supplied by the print control unit 18 with the first identification code ID1 read from the print head 11, with the second identification code ID2 read out from the memory cell 121 of the memory device 12 from the I/O unit 9, as well as with the key code PK from an input unit 102 (or a memory unit of the postage meter machine 1). The decryption unit 101 calculates a security code MAC* therefrom according to the same algorithm used by the print head manufacturer. Subsequently, this generated security code MAC* as well as the security code MAC read from the memory cell 122 are supplied to a comparison unit 103 that enables the print unit 2 only given coincidence, and otherwise blocks operation of the print unit 2 to prevent abuses.

In the inventive postage meter machine, printing thus will not be possible when print head 11 and memory unit 12 do not mate, for example because the memory unit 12 was removed from the original print head and attached to a different print head or when a print head to which no memory unit whatsoever is attached is attempted to be employed. In order to prevent the print head from being refilled, a usage counter is also provided that sends a signal to the computer unit 10 when the ink of the print head has been exhausted. Subsequently, the security code MAC* in the decryption unit 101 is always set to zero, so that an agreement with the stored security code MAC never occurs and the print unit always remains inhibited. This inhibit is only removed when a new print head is used.

The memory unit 12 can be installed in the postage meter machine separately from the print head 11. The inventive method then functions analogously, with the correct memory unit being requested given an incorrectly installed memory unit. Instead of being provided in the memory unit 12, a filling level memory for the print head can be maintained in the computer unit 10 for the unique combination of the two identification codes and the security code.

Figure 5:
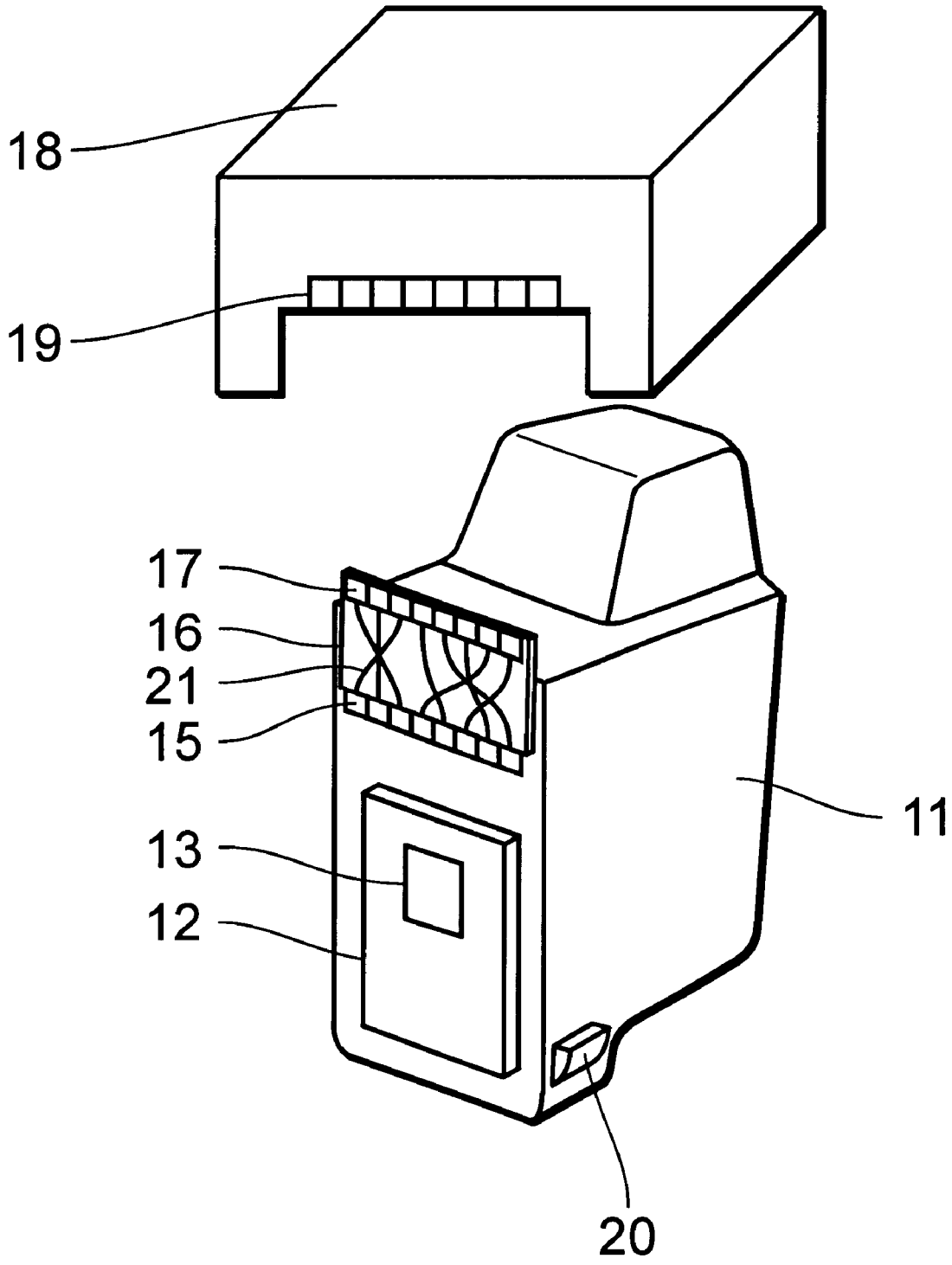
FIG. 5 illustrates an alternative embodiment of an inventive print head.

An alternative embodiment of the inventive print head is shown in FIG. 5. In addition to the memory unit 12, this embodiment also includes a connection unit 16. Contacts 15 of the print head 11 are connected to contacts 19 of the print control unit 18 with this connection unit 16. To that end, the connection unit 16 has contacts 17 that come into contact with the contacts 19 upon introduction of the print head 11 into the print control unit 18. The contacts 15 are not connected to the contacts 17 in a direct sequence; on the contrary, the contacts 15 are connected to the contacts 17 with connecting lines 21 situated on the connection unit 16 that are arbitrarily permutated according to a permutation code. This permutation code can be different for each connection unit 16 and, thus, for each print head 11. When sending the print signals from the print control unit 18, this permutation must also be included. To this end, the permutation code is preferably likewise stored on the memory unit 12 and can be read out by the print control unit 18 before printing. In contrast to the embodiment shown in FIG. 2, the frame 20 is mounted remote from the memory chip 13 in this embodiment, namely at the outside at the lower end of the print head 11, which likewise has a structure different from the print head shown in FIG. 2. The projection 20 thereby again serves as mechanical obstacle against employment of the print head in conventional ink jet printers.

Alternatively, the permutation code can be attached to the connection unit 16 or to the print head 11 and serve as the first identification code, which is then used for generating the security code both when manufacturing the print head as well as in the verification of the print head.

The permutation code also can be set to zero when the ink of the print had has been exhausted, so that the print head no longer can be subsequently employed.

Different abuses are also prevented by the measures included in the embodiment of FIG. 5. Thus, such a print head cannot be used in conventional printers and a replacement of memory unit and/or connection unit is not possible.

Although modifications and changes may be suggested by those skilled in the art, it is the intention of the inventor to embody within the patent warranted hereon all changes and modifications as reasonably and properly come within the scope of his contribution to the art.

I claim as my invention:

1. A postage meter machine for franking postal items, comprising:

a computer unit;

a printer unit adapted for printing a franking image on postal matter, connected to and controlled by said computer unit and having a replaceable, removable print head;

a first identification code arranged at said print head so as to be machine readable;

a memory unit uniquely allocated to said print head having a second identification code and a stored security code stored therein, said stored security code being generated with a key code from said first identification code and said second identification code using an encryption algorithm; and an input unit connected to said computer unit which, upon insertion of said print head in said printer unit, reads said first identification code and reads out said second identification code and said stored security code and supplies said first identification code, said second identification code and said stored security code to said computer, said computer having access to said key code and said encryption algorithm and generating a generated security code from said first identification code, said second identification code and said key code using said encryption algorithm, and comparing said generated security code to said stored security code and enabling usage of said print head in said printer unit only if said generated security code and said stored security code coincide.

2. A postage meter machine as claimed in claim 1 wherein said print head has a mechanical configuration which prevents insertion of said print head in a printer other than a printer unit for use in a postage meter machine.

3. A postage meter machine as claimed in claim 1 wherein said memory unit is physically attached to said print head.

4. A postage meter machine as claimed in claim 1 wherein said memory unit is installed in said postage meter machine separately from said print head.

5. A postage meter machine as claimed in claim 1 wherein said memory unit is a chip card.

6. A postage meter machine as claimed in claim 1 wherein said storage security code is generated before a first use of said print head and is stored in said memory unit before said first use of said print head.

7. A postage meter machine as claimed in claim 1 wherein said first identification code is an arbitrary number attached to said print head and wherein said second identification code is a serial number stored in said memory unit.

8. A postage meter machine as claimed in claim 1 wherein said printer unit includes a print control unit having print control contacts, and wherein said print head has print head contacts, and wherein said print head further comprises a connector unit having a plurality of permutatable connection paths for connecting said print control contacts to said print head contacts according to permutation code, and wherein said print control unit participates in controlling said print head, with said computer unit, dependent on said permutation of said connection paths.

9. A postage meter machine as claimed in claim 8 wherein said permutation code is attached to said print head as the first identification code, and wherein said second identification code is a serial number stored in said memory unit.

10. A postage meter machine as claimed in claim 1 further comprising an arrangement for measuring ink consumption, from an ink supply, by said print head, and wherein said memory unit stores a running total of ink consumption and generates an identifier when said ink supply is exhausted.

11. A print head adapted for removable insertion into a printer unit of a postage meter machine for franking postal items, said print head having a machine readable first identification code disposed thereon, and having a memory unit uniquely allocated to said print head in which a second identification code and a security code are stored, said security code being generated with a key code from said first identification code and said second identification code using an encryption algorithm.

12. A method for authentication of a print head for a postage meter machine for franking postal items comprising:

disposing a machine readable first identification code on a print head;

uniquely allocating a memory unit to said print head and storing in said memory unit a second identification code and a stored security code generated from said first identification code, said second identification code and a key code using an encryption algorithm;

upon insertion of said print head into a printer, machine reading said first identification code and reading said second identification code and said storage security code out of said memory unit;

supplying said first identification code, said second identification code and said stored security code from said print head to a computer;

providing said computer with access to said key code and said encryption algorithm;

in said computer, generating a generated security code from said first identification code, said second identification code, and said key code using said encryption algorithm;

in said computer, comparing said generated security code to said storage security code; and enabling usage of said print head in said printer only if said generated security code and said storage security code coincide.

13. A method as claimed in claim 12 wherein said postage meter machine is initialized before usage thereof, and comprising authenticating said print head prior to each initialization of said postage meter machine.

* * * * *